US008159439B2

(12) United States Patent
Lee et al.

(10) Patent No.: US 8,159,439 B2
(45) Date of Patent: Apr. 17, 2012

(54) DATA DRIVING CIRCUIT INCLUDING A FIRST OPERATOR THAT GENERATES A FLAG SIGNAL BASED ON A LOAD SIGNAL AND A RESET SIGNAL AND A SECOND OPERATOR THAT GENERATES A HORIZONTAL SCANNING IDENTICAL SIGNAL, DISPLAY APPARATUS COMPRISING THE SAME AND CONTROL METHOD THEREOF

(75) Inventors: Jae-han Lee, Asan-si (KR); Chang-soo Lee, Uijeongbu-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 817 days.

(21) Appl. No.: 12/241,523

(22) Filed: Sep. 30, 2008

(65) Prior Publication Data

US 2009/0160844 A1 Jun. 25, 2009

(30) Foreign Application Priority Data

Dec. 21, 2007 (KR) ..... 10-2007-135344

(51) Int. Cl.
*G09G 3/36* (2006.01)

(52) U.S. Cl. ..... 345/96; 345/208

(58) Field of Classification Search ..... 345/87, 345/214, 96

See application file for complete search history.

(56) References Cited

U.S. PATENT DOCUMENTS

| | | | | |
|---|---|---|---|---|
| 7,126,376 | B2 * | 10/2006 | Kida et al. | 326/46 |
| 2002/0039096 | A1 * | 4/2002 | Katsutani | 345/204 |
| 2002/0075255 | A1 * | 6/2002 | Baek et al. | 345/212 |
| 2006/0197731 | A1 * | 9/2006 | Lee et al. | 345/98 |
| 2007/0200836 | A1 * | 8/2007 | Jung | 345/204 |

FOREIGN PATENT DOCUMENTS

| | | | |
|---|---|---|---|
| JP | 04284415 | A * | 10/1992 |
| JP | 11119744 | | 4/1999 |
| JP | 2006-113384 | | 4/2006 |
| JP | 2007-079132 | | 3/2007 |
| KR | 1020050008881 | A | 1/2005 |
| KR | 1020050035418 | A | 4/2005 |
| KR | 1020070002955 | A | 1/2007 |

* cited by examiner

*Primary Examiner* — Chanh Nguyen
*Assistant Examiner* — John Kirkpatrick
(74) *Attorney, Agent, or Firm* — F. Chau & Associates, LLC

(57) ABSTRACT

A data driving circuit receiving an image signal and applying a data signal based on the image signal to a display panel, the data driving circuit includes a signal generator that generates a horizontal scanning identical signal based on the image signal and a load signal instructing an output of the data signal to the display panel; a signal amplifier that alternately converts a polarity of an offset compensation value from positive to negative and amplifies the image signal based on the offset compensation value; and a controller that counts pulses of the horizontal scanning identical signal and controls the signal amplifier to retain the converted polarity of the offset compensation value until a counted reaches a predetermined reference value.

10 Claims, 5 Drawing Sheets

DATA DRIVING CIRCUIT INCLUDING A FIRST OPERATOR THAT GENERATES A FLAG SIGNAL BASED ON A LOAD SIGNAL AND A RESET SIGNAL AND A SECOND OPERATOR THAT GENERATES A HORIZONTAL SCANNING IDENTICAL SIGNAL, DISPLAY APPARATUS COMPRISING THE SAME AND CONTROL METHOD THEREOF

CROSS-REFERENCE TO RELATED APPLICATION

This application claims the benefit of Korean Patent Application No. 10-2007-135344, filed on Dec. 21, 2007, in the Korean Intellectual Property Office, the disclosure of which is incorporated herein by reference.

BACKGROUND OF THE INVENTION

1. Technical Field

The present invention relates to a data driving circuit, a display apparatus comprising the same and a control method thereof.

2. Discussion of Related Art

Generally, a liquid crystal display and an organic light emitting device include a thin-film transistor substrate to independently drive each pixel.

The thin-film transistor substrate is provided with a plurality of gate lines transmitting gate signals and a plurality of data signals transmitting data signals. The thin-film transistor substrate includes a thin-film transistors connected to the gate lines and the data lines, and a plurality of pixel electrodes connected to the thin-film transistors. The above-described display apparatus includes a gate driver turning on/turning off the thin-film transistors and a data driver applying the data signals corresponding to image signals to the date lines.

The data driver may include a digital-analog converter converting a received digital signal to an analog signal and an amplifier, which is connected to the digital-analog converter, amplifying the data signal. The amplifier has a plurality of switches formed of transistors and may have an offset, even though an input value is "0" for its inherent character. The offset may be a positive offset having a positive value or a negative offset having a negative value. To cancel these offsets, the sum of the data signal and an offset compensation value is input to the amplifier. The polarity of the offset compensation value is alternately changed on a frame by frame basis, according to a frame offset cancellation method. In the case of the frame offset cancellation method, it is very important to exactly identify the frame changes. Generally, a vertical synchronization start signal indicating a beginning of a gate signal is useful to determine the frame's change point. Recently, one or more of the vertical synchronization start signals are output for one frame according to a precharging driving method or an impulsive driving method. Thus, the data driver may have a problem identifying a frame and its start point.

SUMMARY OF THE INVENTION

Exemplary embodiments and/or advantages of the present invention will be set forth in the description which follows and, in part, will be understood from the description, or may be learned by practice of the present invention.

The foregoing and/or other exemplary embodiments of the present invention are achieved by providing a data driving circuit receiving an image signal and applying an image signal and applying a data signal based on the image signal to a display panel, the data driving circuit includes a signal generator that generates a horizontal scanning identical signal based on the image signal and a load signal instructing the output of the data signal to the display panel; a signal amplifier that alternately converts a polarity of an offset compensation value from positive to negative and amplifies the image signal based on the offset compensation value; and a controller that counts pulses of the horizontal scanning identical signal and controls the signal amplifier to retain the converted polarity of the offset compensation value until a counted value reaches a predetermined reference value.

As used herein, the phrase horizontal scanning identical signal distinguishes an internally generated signal from a horizontal scanning signal received from the outside.

According to an exemplary embodiment of the present invention, the signal amplifier alternately converts a polarity of the offset compensation value based on a vertical synchronization start signal input thereto and the control of a controller, and wherein the controller disables the vertical synchronization start signal until the counted value reaches the reference value.

In an exemplary embodiment of the present invention, the image signal includes a reset signal indicating the start of image signal, the signal generator comprises a first operator that generates a flag signal based on the load signal and the reset signal and a second operator that generates the horizontal scanning identical signal based on the flag signal and the reset signal.

According to an exemplary embodiment of the present invention, the horizontal scanning identical signal has a larger amplitude than the amplitude of the reset signal.

In an exemplary embodiment of the present invention, the image signal is transmitted through a low-voltage differential signaling (LVDS) interface or a mini-low-voltage differential signaling (mini-LVDS) interface.

According to an exemplary embodiment of the present invention, a display apparatus that has a display panel includes: an image controller that outputs a received image signal, a load signal informing an output of a data signal based on the received image signal to display panel and a vertical synchronization start signal; a data driving circuit that comprises a signal generator that generates a horizontal scanning identical signal based on the image signal and the load signal instructing an output of the data signal to the display panel, a signal amplifier that alternately converts a polarity of an offset compensation value from positive to negative, amplifies the data signal based on the offset compensation value and outputs the amplified data signal to the display panel, and a controller that counts pulses of the horizontal scanning identical signal and controls the signal amplifier to retain the converted polarity of the offset compensation value until a counted value reaches a predetermined reference value.

In an exemplary embodiment of the present invention, a control method of a display apparatus that includes a display panel, and a signal amplifier alternately converting a polarity of an offset compensation value, from positive to negative, amplifying a data signal based on the offset compensation value and outputting the amplified data signal to the display panel, wherein the method includes: generating a horizontal scanning identical signal based on a received image signal and a load signal; counting pulses of the horizontal scanning identical signal after converting the polarity of the offset compensation value; retaining the converted polarity of the offset compensation value until a counted value reaches a predetermined reference value.

BRIEF DESCRIPTION OF THE DRAWINGS

Exemplary embodiments of the present invention will be understood in more detail from the following descriptions taken in conjunction with the accompanying drawings, of which.

DETAILED DESCRIPTION OF EXEMPLARY EMBODIMENTS

Figure 1:
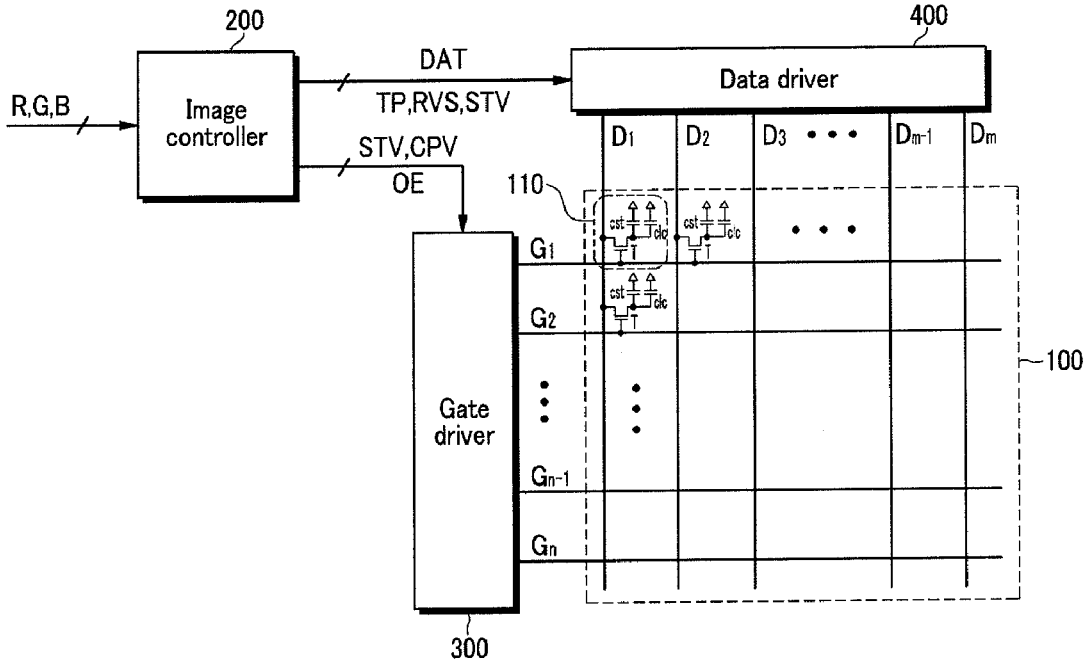
FIG. 1 is a block diagram of a display apparatus according to an exemplary embodiment of the present invention.

Reference will now be made in detail to the exemplary embodiments of the present invention, examples of which are illustrated in the accompanying drawings, wherein like reference numerals refer to like elements throughout.

FIG. 1 is a block diagram of a display apparatus according to an exemplary embodiment of the present invention.

As shown in FIG. 1, the display apparatus includes a display panel 100, an image controller 200, a gate driver 300, and a data driver 400. The display apparatus may be a liquid crystal display having a liquid crystal display panel, such as shown at 100.

The display panel 100 includes two insulating substrates (not shown) and a liquid crystal layer (not shown) disposed between the substrates. The display panel 10 further includes signal lines G1-Gn and D1-Dm.

A plurality of pixels 110 are arranged in a matrix form on a lower substrate. Each pixel 110 includes a thin-film transistor T connected to the signal lines G1-Gn and D1-Dm.

The signal lines G1-Gn and D1-Dm include a plurality of gate lines G1-Gn transmitting gate signals and a plurality of data lines D1-Dm transmitting data signals corresponding to image signals. The gate lines G1-Gn extend in a row direction and the data lines D1-Dm extend in a column direction substantially perpendicular to the gate lines G1-Gn.

Each pixel 110 further include a liquid crystal capacitor Clc and a storage capacitor Cst that are connected to the thin-film transistor T. If desired, the storage capacitor Cst may be omitted. The thin-film transistor T is formed on the lower substrate and has three terminals, a control terminal connected to one of the gate lines G1-Gn, an input terminal connected to one of the data lines D1-Dn, and an output terminal connected to both the LC capacitor Clc and the storage capacitor Cst. Color filters (not shown) are formed in an area corresponding to the pixels 110 and comprise red, green, and blue colors to display a color image.

The gate driver 300 is called a scan driver and applies gate signals, each which includes a gate-on voltage and a gate-off voltage, to the gate lines G1-Gn.

The data driver 400 is called a source driver and converts image signals DAT from the image controller 200 to analog data signals and supplies the analog data signals to the pixels 110 through the data lines D1-Dm. The data driver 400 generally may be composed of plural integrated circuits (not shown) and corresponds to a data driving circuit. The plural integrated circuits are connected to the display panel 100 along the longitude direction of the display panel 100. The image signals DAT from the image controller 200 are provided to the plural integrated circuits along the same direction. The data driver 400 will be described below in greater detail.

The image controller 200 is called a timing controller. The image controller 200 outputs various control signals to the gate driver 300 and the data driver 400, and revises the image signals R, G, and B fed in from the outside to output the image signals DAT to the data driver 400.

The image controller 200 outputs a vertical synchronization start signal STV with a high level and a low level, a gate clock signal with a high level and a low level controlling the output timing of a gate-on voltage, and a gate-on enable signal OE with a high level and a low level limiting a width of the gate-on voltage to the gate driver 300.

The larger the display panel 100 is and the higher the frequency for displaying the image (hereinafter, referred to as "one frame image") of one frame is, the lower the charging capacity of the liquid crystal layer is. In that case, a precharging driving method, which means precharging the pixels 110 before the data signals is applied to the pixels 110, is applied as one driving method of the display apparatus.

Moreover, an impulsive driving method, which means black data being applied to the display panel 100, may be used to improve a response time of the liquid crystal layer (not shown). In the precharging driving method and the impulsive driving method, a plurality of gate signals are applied to each of the gate lines G1-Gn during the display of one frame image. That is, pulses of the vertical synchronization start signal STV are applied to the gate driver 300.

The image controller 200 outputs a load signal TP for instructing the application of the appropriate data signals corresponding to the image signals DAT for one pixel row to the data lines D1-Dm, an inversion control signal RVS for reversing the polarity of the data signals (with respect to the common voltage) and a data clock signal. The image controller 300 also outputs the vertical synchronization start signal STV. The vertical synchronization start signal STV is needed to convert a polarity of an offset compensation value of a signal amplifier 420, shown in FIG. 2, in the data driver 400.

The image controller 200 according to an exemplary embodiment of the present embodiment transmits the image signals DAT to the data driver 400 through a low-voltage differential signaling interface or a mini-low-voltage differential signaling interface. In these interfaces, the image controller 200 does not output a horizontal synchronization start signal STH to the date driver 400. The image controller 200 outputs the image signals DAT by a pixel row. A reset signal may be included in a first part of the image signals DAT for each pixel row. The reset signal RST instructs or signifies the start of the image signals DAT for one pixel row instead of the horizontal synchronization start signal STH.

Figure 2:
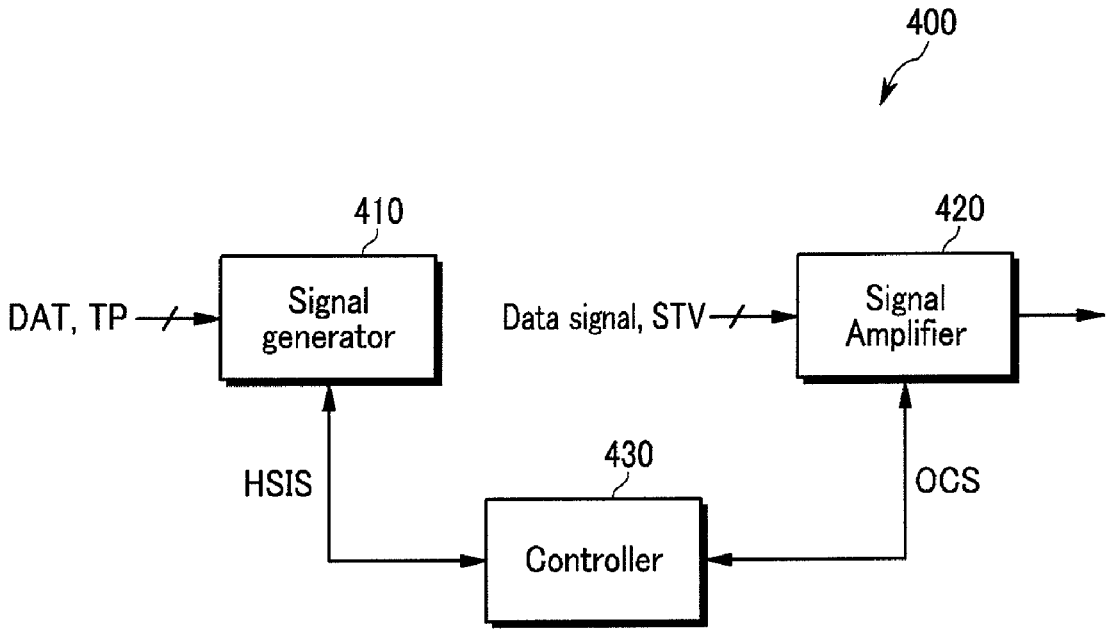
FIG. 2 is a block diagram of a data driver according to an exemplary embodiment of the present invention.
Figure 3:
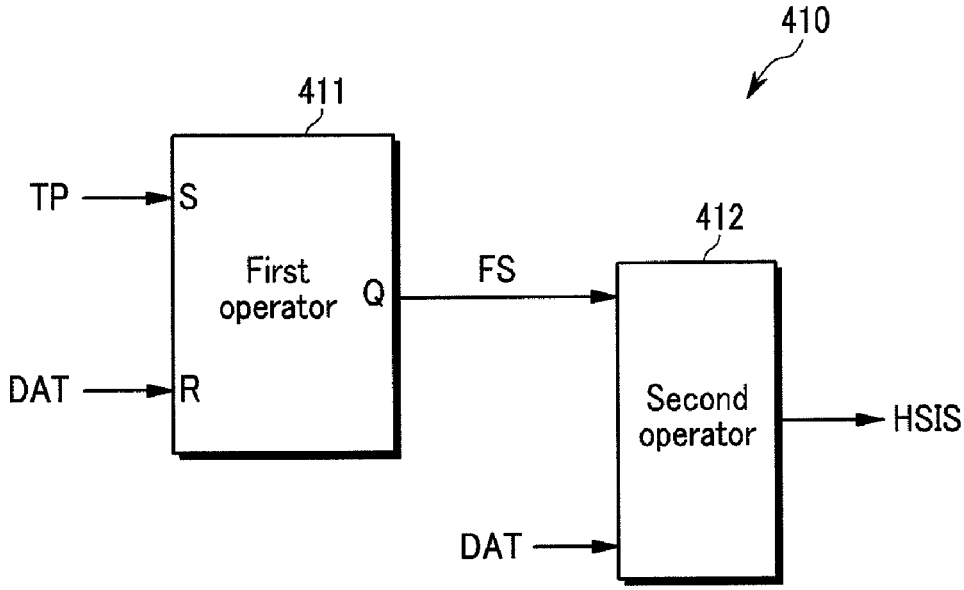
FIG. 3 is a block diagram of a signal generator according to an exemplary embodiment of the present invention.
Figure 4:
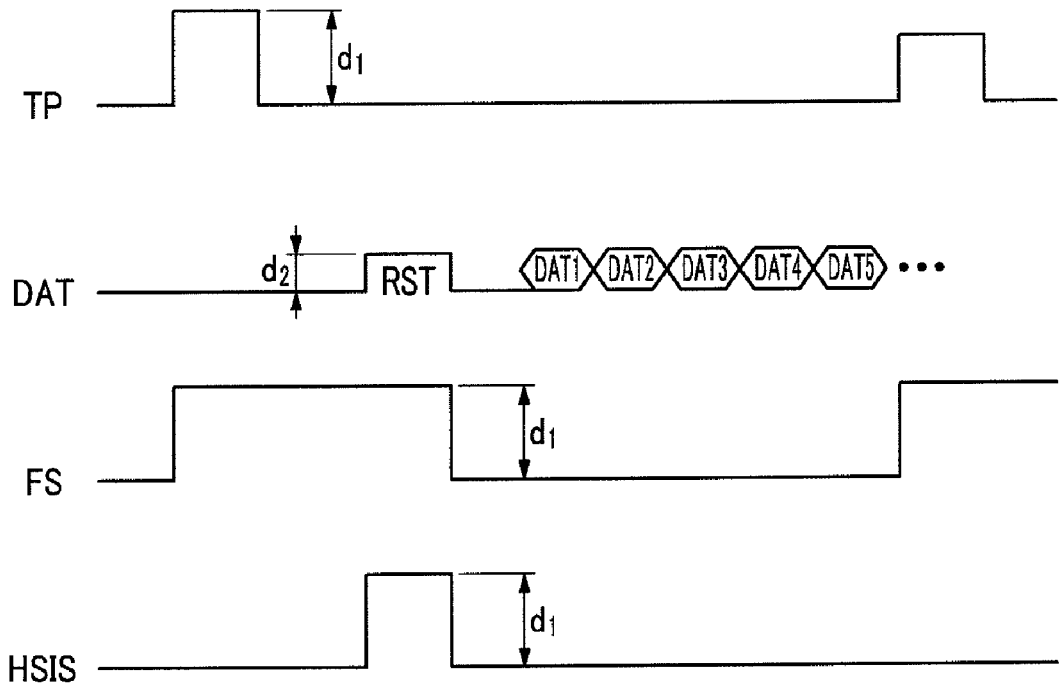
FIG. 4 is a timing diagram useful in describing the generation of a horizontal scanning identical signal according to an exemplary embodiment of the present invention.

FIG. 2 is a block diagram of a data driver 400, FIG. 3 is a block diagram of a signal generator of FIG. 2 according to an exemplary embodiment of the present invention, and FIG. 4 is a timing diagram useful in describing the generation of a horizontal scanning identical signal according to an exemplary embodiment of the present invention.

As shown in FIG. 2, the data driver 400 includes a signal generator 410, a signal amplifier 420, and a controller 430 controlling the above-mentioned elements.

The signal generator 410 generates a horizontal scanning identical signal HSIS based on the image signals DAT and the load signal TP instructing the output of the data signals to the display panel 100.

As shown in FIG. 3, the signal generator 410 includes a first operator 411 and a second operator 412, that is, an AND gate. The first operator 411 generates a flag signal FS based on the image signals DAT and the reset signal RST included in the image signals DAT for each pixel row. The second operator 412 generates a horizontal scanning identical signal HSIS based on the flag signal FS and the reset signal RST.

As shown in FIG. 4, the image signals DAT for a current frame are output after the load signal TP of the preceding frame. The image signals DAT includes the reset signal RST in front of the first image signal DAT1 for the first pixel of the pixel row. That is, the reset signal RST is included in the image signals DAT and informs the beginning of the image signals DAT for each pixel row. A level (d2) of the image signals DAT is approximately 150 mV to 250 mV and the load signal TP has a level (d1) of about 3.3V. The amplitude (d2) of the image signals DAT is smaller than that (d1) of the load signal TP.

As shown in FIG. 4, the flag signal FS has a high level from a rising edge of the load signal TP to a falling edge of the reset signal RST. The first operator 411 may include a SR latch as a logical circuit. When the load signal TP of a high level is input through a set terminal S, the first operator 411 outputs the flag signal FS of a high level through an output terminal Q. The flag signal FS remains the high level while both the load signal TP and the reset signal RST are the high level. After that, the flag signal FS from the output terminal Q becomes a low level when the reset signal RST is a low level. The flag signal FS is input to the second operator 412. The amplitude of the flag signal FS corresponds to the amplitude (d1) of the load signal TP.

The second operator 412 may be a logical circuit outputting a signal when both the flag signal FS and the reset signal RST are input. The amplitude of the horizontal scanning identical signal HSIS also corresponds to the amplitude (d1) of the load signal TP.

In sum, the signal generator 410 generates the horizontal scanning identical signal HSIS of a high level using the reset signal RST of a low level in the image signals DAT. The horizontal scanning identical signal HSIS is generated each horizontal scanning period, that is, whenever the image signals DAT for one pixel row are applied to the data driver 400, because the horizontal scanning identical signal HSIS is based on the load signal TP for the preceding frame and the reset signal RST of the image signals DAT for a current frame.

Returning to FIG. 2, the signal amplifier 420 alternately converts the polarity of the offset compensation value between positive and negative and amplifies data signals, which are converted into analog signals based on the image signals DAT, by adding the offset compensation value. The signal amplifier 420 may include an operating amplifier amplifying the data signals. Based on the physical character of the operating amplifier of the signal amplifier 420, an offset occurs. The offset may be a positive offset having a positive value or a negative offset having a negative value. The signal amplifier 420 alternately converts the polarity of the offset compensation value from positive to negative or from negative to positive to cancel these offsets. When a converting period of the polarity of the offset compensation value is constant, a change of the polarity is counterbalanced. If the polarity of the offset compensation value is not converted or the converting period of the polarity is not constant, the amplified data signals based on the offset compensation value may be distorted. The signal amplifier 420 may convert the polarity of the offset compensation value based on the vertical synchronization start signal STV, that is, the pulse of the vertical synchronization start signal and an offset control signal OCS.

The controller 430 counts the pulses of the horizontal scanning identical signal HSIS and controls the signal amplifier 420 to retain the polarity of the offset compensation value until the counted value reaches a predetermined reference value after the converting of the polarity. As described, the image amplifier 420 may convert the polarity of the offset compensation value using the vertical synchronization start signal because the vertical synchronization start signal is generally output one frame at a time. That is, the distortion of the data signals is prevented by changing the converting period of the offset compensation value for each frame. Recently, however, more than one vertical synchronization start signal is output for one frame according to a precharging driving or an impulsive driving. In that case, the data driver 400 may have a problem in identifying a frame.

Referring to FIG. 2, the controller 430 counts pulses of the horizontal scanning identical signal HSIS after converting the polarity of the offset compensation value and output the offset control signal with a low or high level for maintaining the converted polarity of the offset compensation value until the counted value reaches the reference value. Even if a plurality of vertical synchronization start signals STV are output, the polarity of the offset compensation value is not changed until the counted value reaches the reference value. The counted value of pulses of the horizontal scanning identical signal HSIS refers to the number of pixel rows. That is, the counted value means the number of the gate lines G1-Gn applied with the gate signals for applying the data signals. Thus, the time until the counted value reaches the reference value may be set at a time corresponding to one frame. The set time may be the maximum number n of the gate lines G1-Gn. After the vertical synchronization start signal STV instructing the start of image signals DAT for one frame is output, the vertical synchronization start signals STV for the precharging driving or the impulsive driving approximately are output within a predetermined time.

The reference value may be the predetermined time. The reference value may be set according to an output interval of the vertical synchronization start signals STV when the plural vertical synchronization start signals STV for the precharging driving or the impulsive driving are output. The controller 430 outputs the offset control signal OCS to the signal amplifier 420 to control the change of the polarity of the offset compensation value or it may directly disable the vertical synchronization start signal STV. The controller 430 may include various operators or logical devices to generate the offset control signal.

The gate signals are sequentially applied to the gate line G1-Gn using the vertical synchronization start signal STV. If it is assumed that after the gate signal is applied to the $30^{th}$ gate line G30, the vertical synchronization start signal STV for an impulsive driving is again output, the reference value may be set to 31 or more. The signal generator 410 outputs the horizontal scanning identical signal HSIS having the high amplitude (d1) to the controller 430, so that the controller 430 easily recognizes a horizontal scanning.

Figure 5:
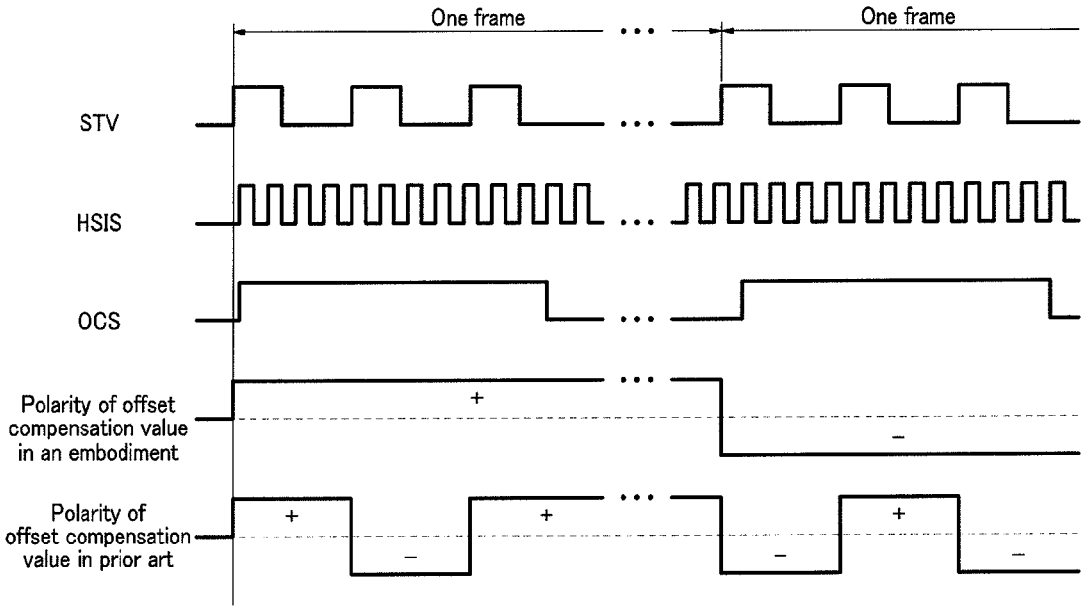
FIG. 5 is a timing diagram useful in describing the conversion of the polarity of an offset compensation value according to an exemplary embodiment of the present invention.

FIG. 5 is a timing diagram useful in describing conversion of the polarity of the offset compensation value according to an exemplary embodiment of the present invention.

As shown FIG. 5, a plurality of the vertical synchronization start signals STV are output during one frame. In practice, the polarity of the offset compensation value is changed twice by the vertical synchronization start signals STV during the one frame.

The controller 430, however, counts the pulses of the horizontal scanning identical signal HSIS after outputting the vertical synchronization start signal STV signifying the beginning of one frame. The controller 430 outputs an offset control signal OCS of a high level to the signal amplifier 420 until the counted value reaches the reference value.

Even though a pulse of at least one vertical synchronization start signal STV is applied to the signal amplifier 420 for maintaining a high level of the offset control signal OCS, the signal amplifier 420 does not change the polarity of the offset compensation value. That is, the signal amplifier 420 identifies the start of a new frame and changes the polarity of the offset compensation value when a pulse of the vertical synchronization start signal STV is applied during the time the offset control signal OCS has a low level.

Thereby, the offset control signal OCS keeps the polarity of the offset compensation value from changing until the counted value reaches the reference value, even though plural pulses of the at least one synchronization start signal STV are output.

The converted polarity of the offset compensation value by the signal amplifier 420 is sustained by the offset control signal OCS during one frame, and then the polarity of the offset compensation value is again converted by the vertical synchronization start signal STV informing of a start of the next frame.

Figure 6:
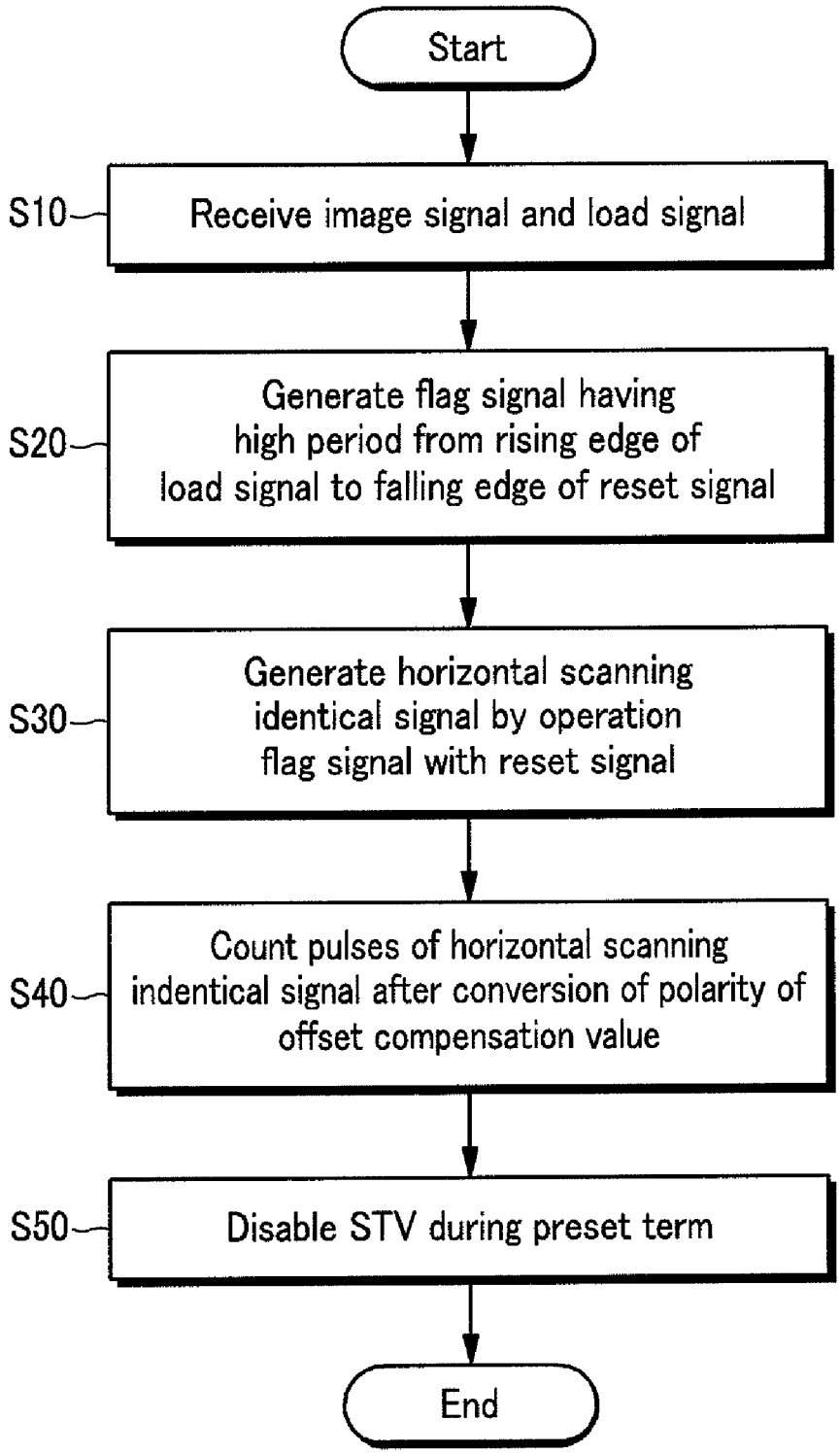
FIG. 6 is a block diagram describing a control method of a display apparatus according to an exemplary embodiment of the present invention.

FIG. 6 is a chart describing a control method of a display apparatus according to an exemplary embodiment of the present invention.

As shown FIG. 6, first, at step S10 the data driver 400, shown in FIG. 1, receives the image signals DAT from the image controller 200 and the load signal TP.

The signal generator 410, shown in FIG. 2, generates the flag signal FS having a high level from a rising edge of the load signal TP to a falling edge of the reset signal RST, in step S20, and the horizontal scanning identical signal HSIS based on the flag signal FS and the reset signal RST in step S30. The horizontal scanning identical signal HSIS is generated by an AND operation of the flag signal FS with the reset signal RST. The controller 430 uses the horizontal scanning identical signal HCIS to measure the time needed to prevent the polarity of the offset compensation value from being changed.

The controller 430 counts pulses of the horizontal scanning identical signal HSIS after the polarity of the offset compensation value is converted in step S40.

The controller 430 controls the inputted vertical synchronization start signal STV to be disabled during the preset term, that is, until the counted value reaches the reference value to retain the converted polarity offset compensation value in step S50.

Although exemplary embodiments of the present invention have been shown and described, it will be appreciated by those of ordinary skill in the art that changes may be made in these exemplary embodiments without departing from the principles and spirit of the present invention, the scope of which is only defined in the appended claims and their equivalents.

What is claimed is:

1. A data driving circuit receiving an image signal and applying a data signal based on the image signal to a display panel, the data driving circuit comprising:

a signal generator that generates a horizontal scanning identical signal based on the image signal and a load signal instructing an output of the data signal to the display panel, wherein the image signal comprises a reset signal indicating the start of the image signal, and the signal generator comprises a first operator that generates a flag signal based on the load signal and the reset signal and a second operator that generates the horizontal scanning identical signal based on the flag signal and the reset signal, wherein the flag signal rises at a rising edge of the load signal and falls at a falling edge of the reset signal;

a signal amplifier that alternately converts a polarity of an offset compensation value from positive to negative and amplifies the image signal based on the offset compensation value; and a controller that counts pulses of the horizontal scanning identical signal and controls the signal amplifier to retain the converted polarity of the offset compensation value until a counted value reaches a predetermined reference value.

2. The data driving circuit of claim 1, wherein the signal amplifier alternately converts a polarity of the offset compensation value based on a vertical synchronization start signal input thereto and the control of the controller, and wherein the controller disables the vertical synchronization start signal until the counted value reaches the reference value.

3. The data driving circuit of claim 1, wherein the horizontal scanning identical signal has a larger amplitude than an amplitude of the reset signal.

4. The data driving circuit of claim 1, wherein the image signal is transmitted through a low-voltage differential signaling interface or a mini-low-voltage differential signaling interface.

5. A display apparatus that has a display panel, the display apparatus comprising:

an image controller that outputs a received image signal, a load signal informing output of a data signal based on the received image signal to the display panel and a vertical synchronization start signal;

a data driving circuit that includes a signal generator that generates a horizontal scanning identical signal based on the image signal and the load signal instructing an output of the data signal to the display panel, wherein the image signal comprises a reset signal indicating the start of the image signal, and the signal generator comprises a first operator that generates a flag signal based on the load signal and the reset signal and a second operator that generates the horizontal scanning identical signal based on the flag signal and the reset signal, wherein the flag signal rises at a rising edge of the load signal and falls at a falling edge of the reset signal, a signal amplifier that alternately converts a polarity of an offset compensation value from positive to negative, amplifies the image signal based on the offset compensation value and outputs the amplified data signal to the display panel, and a controller that counts pulses of the horizontal scanning identical signal and controls the signal amplifier to retain the converted polarity of the offset compensation value until a counted value reaches a predetermined reference value.

6. The display apparatus of claim 5, wherein the image signal is transmitted through a low-voltage differential signaling interface or a mini-low-voltage differential signaling interface.

7. The display apparatus of claim 5, wherein the image controller generates a plurality of vertical synchronization start signals during one frame.

8. A control method of a display apparatus comprises a display panel, a signal amplifier alternately converting a polarity of an offset compensation value from positive to negative, amplifying a data signal based on the offset compensation value and outputting the amplified data signal to the display panel, the method comprising:

generating a horizontal scanning identical signal based on a received image signal and a load signal, wherein the image signal comprises a reset signal indicating the start of one pixel row, and the generating the horizontal scanning identical signal comprises generating a flag signal based on the load signal and the reset signal and generating the horizontal scanning identical signal based on the flag signal and the reset signal, wherein the flag signal rises at a rising edge of the load signal and falls at a falling edge of the reset signal;

counting pulses of the horizontal scanning identical signal after converting the polarity of the offset compensation value;

retaining the converted polarity of the offset compensation value until a counted value reaches a predetermined reference value.

9. The method of claim 8, wherein the signal amplifier alternately converts a polarity of the offset compensation value based on a vertical synchronization start signal input, and the retaining the converted polarity of the offset compensation value comprises disabling the vertical synchronization start signal until the count value reaches the reference value.

10. The method of claim 8, wherein the image signal is transmitted through a low-voltage differential signaling interface or a mini-low-voltage differential signaling interface.

* * * * *